United States Patent [19]

Bertho et al.

[11] Patent Number: 5,057,246

[45] Date of Patent: Oct. 15, 1991

[54] VISCOUS DETERGENT COMPOSITION CAPABLE OF BEING DILUTED AND PROCESS FOR PRODUCING IT

[75] Inventors: Annette Bertho, Aulnay-sous-Bois; Daniel Charpin, Saint-Maur; Catherine Heusele, Palaiseau; Patrick Moireau, Vitry-Sur-Seine, all of France

[73] Assignees: Cotelle S.A., Courbevoie; Henkel Entretien, Boulogne Billancourt, both of France

[21] Appl. No.: 76,162

[22] Filed: Jul. 21, 1987

[30] Foreign Application Priority Data

Jul. 25, 1986 [FR] France ..... 86 10790

[51] Int. Cl.[5] ..... C11D 17/00; C11D 1/831; C11D 1/94; C11D 11/00

[52] U.S. Cl. ..... 252/545; 252/173; 252/174; 252/174.21; 252/174.22; 252/546; 252/547; 252/548; 252/558; 252/559; 252/DIG. 1; 252/DIG. 7; 252/DIG. 14

[58] Field of Search ..... 252/136, 153, 139, 526, 252/527, 528, 529, 539, 540, 545, 546, 547, 548, 558, 559, 173, DIG. 1, DIG. 7, DIG. 14, 174.21, 174.22, 174

[56] References Cited

U.S. PATENT DOCUMENTS

| | | | |
|---|---|---|---|
| 3,893,955 | 7/1975 | Hewitt et al. | 252/551 |
| 4,092,273 | 5/1978 | Inamorato et al. | 252/548 |
| 4,110,262 | 8/1978 | Arnau et al. | 252/545 |
| 4,368,147 | 1/1983 | Inamorato et al. | 252/545 |
| 4,375,421 | 3/1983 | Rubin et al. | 252/110 |
| 4,554,098 | 11/1985 | Klisch et al. | 252/547 |
| 4,671,894 | 6/1987 | Lamb et al. | 252/545 |
| 4,675,128 | 6/1987 | Linde et al. | 252/549 |

FOREIGN PATENT DOCUMENTS

| | | |
|---|---|---|
| 0077674 | 4/1983 | European Pat. Off. . |
| 0088612 | 9/1983 | European Pat. Off. . |
| 1462001 | 12/1966 | France . |
| 1501661 | 11/1967 | France . |
| 2304665 | 10/1976 | France . |
| 1164854 | 9/1969 | United Kingdom . |
| 2106927 | 4/1983 | United Kingdom . |

*Primary Examiner*—Paul Lieberman
*Assistant Examiner*—A. Beadles-Hay
*Attorney, Agent, or Firm*—Brumbaugh, Graves, Donohue & Raymond

[57] ABSTRACT

The invention relates to a concentrated, clear, liquid detergent composition capable of being poured and capable of being diluted with water to give a viscous diluted composition. This concentrated composition contains at least one anionic surface agent; a regulator of the viscosity of the diluted composition, consisting of at least one surface agent chosen from the group consisting of nonionic, amphoteric and zwitterionic surface agents, which is combined with at least one acid or its salt in such quantity that it is dissolved in the concentrated composition; the surface agent and the acid or the salt being chosen so that the viscosity of the diluted composition decreases, or increases and then decreases, when the quantity of acid or of its salt increases, for given surface agents, and water.

24 Claims, 1 Drawing Sheet

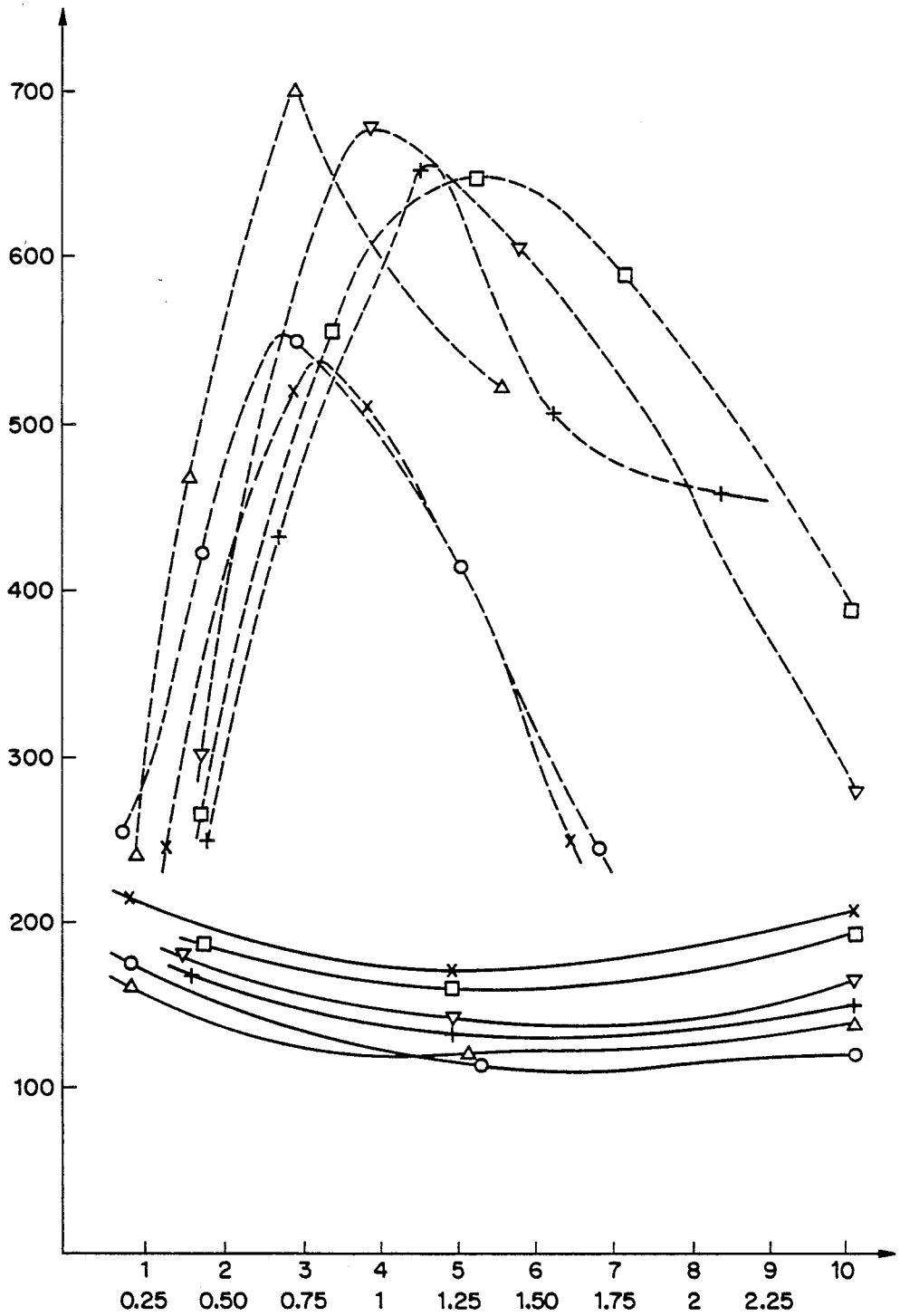
700
600
500
400
300
200
100
1 2 3 4 5 6 7 8 9 10
0.25 0.50 0.75 1 1.25 1.50 1.75 2 2.25

VISCOUS DETERGENT COMPOSITION CAPABLE OF BEING DILUTED AND PROCESS FOR PRODUCING IT

FIELD OF THE INVENTION

The present invention relates to a stable, concentrated, liquid detergent composition which is capable of being diluted with water and is such that the viscosity of the diluted composition is sufficiently high to satisfy the consumers, while the viscosity of the concentrated composition is sufficiently low to enable it to be poured into containers.

BACKGROUND OF THE INVENTION

The objective of the invention is to manufacture a detergent composition which can preferably contain up to approximately 90% of surface-active substances and which can be diluted with several times its volume of water to produce a final composition whose viscosity is satisfactory to the user.

In fact, a diluted composition which has a high viscosity is seen by the consumers as being more effective than a composition which has the same concentration of active substances, but a low viscosity. Until now, when the intention was to produce a diluted composition of satisfactory viscosity, the viscosity of the initial concentrated composition was too high to permit its industrial use.

Another objective of the invention is to manufacture a clear detergent composition which, on being diluted with water by the user, gives a stable, viscous, clear composition. The problem to be solved is unusual, because the dilution is performed by the user and, consequently, under conditions which cannot be controlled. Thus, the dilution is done with a variable quantity of water. In particular, this water is tap water and, depending on the locality, it may be harder or softer and may contain different ions. The water temperature can vary and can lie between 0° and 20° C. The flask in which the dilution is carried out can be of any nature and may be a glass or plastic bottle, of a variety of shapes. These dilution conditions are thus completely different from an industrial dilution where the temperature, the quantity and the quality of the dilution water are strictly controlled, as is the stirring and the shape or the nature of the container in which the composition is placed. The compositions according to the invention are preferably employed as a multipurpose liquid, particularly for dishwashing.

French Patent No. 1,462,001 describes detergent compositions containing:

A) water-soluble, lower alkanolamine salts of alkylbenzenesulfonic or alkyltoluenesulfonic acids, in which the alkyl radical contains from 8 to 18 carbon atoms, and B) nonionic surface agents which are ethoxylated and/or propoxylated ethers of aliphatic alcohols containing at least 8 carbon atoms or of alkylphenols in which the alkyl radical contains from 5 to 18 carbon atoms, and C) fatty acid amides of mono-, di- or triethanolamine, in which the alkyl radical of the fatty acids contains from 10 to 15 carbon atoms, and water, and polyphosphates, as well as methyl cellulose and sodium carboxymethyl cellulose.

The alkanolamine salt of alkylbenzenesulfonic and alkyltoluenesulfonic acids is formed on final addition of alkanolamine to the mixture of surface active agents and fatty acid alkanolamide, in the presence of the cellulose derivatives. These salts are thus formed in situ when the various compounds are mixed.

However, these compositions are not intended to be diluted, and so the viscosity of the diluted composition in relation to the viscosity of the concentrated composition is of no concern.

French Patent No. 1,501,661 describes a process for the preparation of a liquid, concentrated detergent composition, which consists in adding a diethanolamine into a surface active agent compound B of the abovementioned type, pouring in the alkylbenzenesulfonic or alkyltoluenesulfonic acid in order to neutralize it, and then adding an ethanolamine fatty acid amide.

According to this patent, the formation of alkyl-benzene- or alkyltoluenesulfonic acid salts is performed by neutralization in situ, that is to say when the various constituents of the detergent composition are being mixed. Furthermore, when the compositions produced are diluted with water to give compositions containing 50–65% of active substances, they form gels.

European Patent Application No. 77,674 describes compositions comprising an amidobetaine, an organic or inorganic salt, water and an anionic surfactant present in quantities of between 0.25 and 15% by weight. The objective described in this document is to produce a thickened aqueous solution by adding to it from 5 to 25% by weight of amidobetaine. The compositions produced may be clear or opaque and may be gels or pastes. These compositions are of relatively low concentration and contain 50 to 70% of water.

European Patent Application No. 88,612 describes liquid detergent compositions capable of being diluted and containing more than 90% by weight of detergent substances containing more than 50% by weight of ethanolamide derived from copra and polyether, that is to say more than 50% of nonionic surface active agents. However, these compositions have a moderate detergent action, because the detergent activity of nonionic surface active agents is weaker than that of anionic surface active agents. Furthermore, these compositions are ternary mixtures which contain no salt to thicken them, because the latter tends to precipitate out.

British Patent No. 1,164,854 describes detergent compositions containing ammonium or amine salts of alkylbenzenesulfonates, ethoxylated alcohols and salts of di- or trivalent metals, for example magnesium sulfate. However, the viscosity of compositions containing 30% of active substances cannot be controlled as a function of the salt concentration and compositions diluted to. 15% of active substances are turbid.

Another objective of the present invention is to provide clear, concentrated, liquid compositions capable of being diluted and containing more than 50% by weight of anionic surface active agents, based on the total quantity of active substances.

French Patent No. 2,156,825 describes aqueous concentrates of alkoxylated alcohol sulfates whose viscosity is lowered by compounds such as lactic, glyceric, tartaric or citric acid, and this enables them to be diluted without gel formation.

French Patent No. 2,304,665 relates to compositions containing an olefinsulfonate to which an acid salt is added to lower the viscosity of the concentrated compositions. This patent relates further to diluted compositions of these mixtures of olefinsulfonate and acid salt. If desired, an alkanolamide may be added to the diluted compositions for the purpose of raising the viscosity of this composition.

Thus, this patent describes a concentrated composition which contains an anionic surface active agent and a salt, or a diluted composition to which a nonionic surface active agent is added.

French Patent No. 2,343,804 describes a composition containing a polyethoxylated nonionic surface active agent and an acid whose role is to increase the detergency of the composition.

U.S. Pat. No. 4,092,273 describes a detergent composition which contains an agent which counteracts gel formation at low temperature. This agent is a diacid salt.

French Patent No. 2,106,927 describes a descaling composition containing a detergent, an acid and a thickener based on cellulose ether.

OBJECTS OF THE INVENTION

Now, surprisingly and contrary to what could be expected according to the literature, the inventors have been able to produce clear, concentrated detergent compositions, capable of being diluted with water, whose dilution produced diluted compositions having a viscosity which is not appreciably lowered but which, on the contary, could even be controlled relative to the viscosity of the concentrated composition, as is desired, by adding acids or their salts which are soluble in the concentrated composition, the composition containing anionic surface active agents in a quantity which is greater than the quantity of nonionic surface active agents. Furthermore, the diluted compositions are clear.

SUMMARY OF THE INVENTION

The present invention thus relates to a clear, concentrated liquid detergent composition capable of being poured, capable of being diluted with water to give a clear viscous diluted composition, comprising a) at least one anionic surface active agent, b) a regulator of viscosity of the diluted composition, consisting of b1) at leas one surface active agent chosen from the group formed by nonionic, amphoteric and zwitterionic surface agents, in combination with b2) at least one coregulator of viscosity consisting of an acid or its salt in such quantity that it is dissolved in the concentrated composition, the surface active agent ($b_1$) and the acid or its salt ($b_2$) being chosen so that the viscosity of the diluted composition decreases, or increases and then decreases, when the quantity of acid or of its salt increases, for given surface active agents, c) water, d) if desired, at least one nonaqueous solvent, e) if desired, at least one nonionic surface active agent making the concentrated composition more fluid, f) if desired, at least one hydrotrope, g) if desired, an acid which controls the pH of the solution, h) if desired, a fragrance, a colorant, an agent which solubilizes the fragrance and/or a preservative.

The total quantity of surface active agents preferably does not exceed 90% by weight of the composition and the ratio of the total quantity of anionic surface active agents to the total quantity of nonionic surface active agents is greater than 1.

According to the invention, the acid or its salt which represents the component ($b_2$) preferably corresponds to the following general formula: A-C in which A is an anion chosen from the group consisting of saturated or unsaturated aliphatic groups containing 1 to 8 carbon atoms and, if desired, containing hydroxyl groups, more preferably the groups derived from lactic, propionic, succinic, malic, glycolic, glyceric, tartaric, citric, gluconic, saccharic, formic, acetic, butyric, oxalic, maleic or itaconic acids; and of sulfate, iodide, bromide, chloride, thiosulfate, dichromate or orthophosphate groups; and C is H or a cation chosen from the group consisting of sodium, potassium, calcium, ammonium, alkanolammonium, magnesium, iron and copper ions.

When it is intended to produce high concentrations in the case of the composition before dilution, then preference is given to acids or salts such as lactic acid, ammonium lactate or ammonium propionate.

The quantities of coregulator salts ($b_2$) which are added are preferably from approximately 0.5% to approximately 20% by weight.

According to the invention, the surface active agent ($b_1$) of the viscosity regulator is chosen from the group consisting of: amides of $C_8$–$C_{20}$ fatty acids and an amine of formula

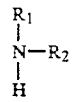

in which $R_1$ and $R_2$ are similar or different and are H, or a $C_1$–$C_4$ alkyl group substituted by one or more OH groups; mono- or polyfunctional, optionally oxyethylenated or oxypropylenated, amides of an acid containing a saturated alkyl or unsaturated alkenyl chain;

alkylbetaines of formula

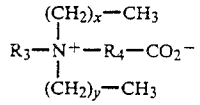

in which $R_3$ is an alkyl or alkenyl radical containing 8 to 20 carbon atoms, $R_4$ is $-(CH_2)_z-$ or $-CH_2-CH(OH)-(CH_2)_z$ x and y are similar or different and equal to 0 or to an integer from 1 to 5 z is equal to an integer from 1 to 5;

alkylsulfobetaines of formula

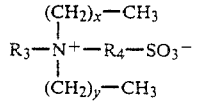

in which $R_3$, $R_4$, x, y and z have the same meanings as above;

alkylaminobetaines of formula

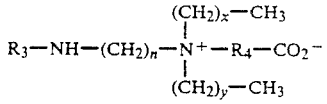

in which $R_3$, $R_4$, x, y and z have the same meanings as above and n is an integer between 1 and 6;

alkylaminosulfobetaines of formula $$R_3-NH-(CH_2)_n-\overset{\overset{(CH_2)_x-CH_3}{|}}{\underset{\underset{(CH_2)_y-CH_3}{|}}{N^+}}-R_4-SO_3^-$$

in which $R_3$, $R_4$, x, y, z and n have the same meanings as above;

alkylamidosulfobetaines of formula $$R_3-CO-NH-(CH_2)_n-\overset{\overset{(CH_2)_x-CH_3}{|}}{\underset{\underset{(CH_2)_y-CH_3}{|}}{N^+}}-R_4-SO_3^-$$

in which $R_3$, $R_4$, x, y, z and n have the same meanings as above;

esters of a fatty acid and of a polyethoxylated and/or polypropoxylated alkylene polyol containing from 1 to 200 ethylene oxide and/or propylene oxide radicals, the fatty acids containing from 8 to 20 carbon atoms and the polyols being chosen from 1,2-ethanediol, 1,2-propanediol, 1,2-butanediol, glycerol, sorbitan and glucose.

The surface active agent of the thickener is more preferably copra diethanolamine or ethoxylated propylene glycol dioleate containing, on average, 55 EO in the molecule.

The quantities of surface active agent of the viscosity regulator are from approximately 2% to approximately 20% by weight.

The compositions according to the invention contain approximately 10% to approximately 70% by weight of one or more anionic surface active agents.

The preferred anionic detergents (a) according to the invention are alkali metal, alkaline-earth metal, ammonium or alkylamine or alkanolamine sulfates or sulfonates; the sulfates or the sulfonates having an alkyl chain which contains from approximately 8 to approximately 22 carbon atoms. Examples of anionic surface active agents which are employed in the compositions according to the invention are sodium, magnesium, ammonium, potassium, alkylamine or alkanolamine alkylsulfates, produced by sulfating alcohols containing from 8 to 18 carbon atoms, sodium, magnesium, mono-, di- or triethanolamine or alkylamine alkylbenzene- or alkyltoluenesulfonates, in which the alkyl group contains from approximately 8 to approximately 18 carbon atoms, the alkyl radical being a branched or unbranched aliphatic chain; sodium or magnesium (for example) paraffinsulfonates and alkenesulfonates and hydroxyalkanesulfonates, in which the alkyl or alkenyl radical contains from approximately 10 to approximately 20 carbon atoms, and alkyl($C_{10}$–$C_{20}$) ethersulfates, derived, for example, from tallow or coconut oil or produced by synthesis.

Examples of anionic surface active agents are sodium, triethanolamine and ammonium lauryl ether sulfates and sodium paraffinsulfonates in which the alkyl chain contains from 13 to 15 carbon atoms. Preference is given to an alkylether sulfate in which the alkyl chain contains from 12 to 14 carbon atoms, for example 70% of $C_{12}$ and 30% of $C_{14}$, containing, on average, 2.2 ethylene oxides in the molecule.

The anionic surface active agent (a) is preferably an alkylbenzenesulfonic acid in which the alkyl chain contains from 10 to 12 carbon atoms, neutralized with an amine containing from 1 to 3 alkylol groups, preferably plus monoethanolamine, which gives the concentrated composition a slightly lower viscosity, which makes it possible to reduce the proportion of nonaqueous solvent, and hence to introduce a higher proportion of active substances into the composition.

It has been found that an essential characteristic of the invention is that the anionic surface active agent or the mixture of anionic surface agents, in solutions containing more than 40% by weight of active substances, needs to be chosen so that it contains sufficiently few ions capable of forming salts which are precipitated out in the concentrated composition. It is desirable, in fact, that the concentrated compositions according to the invention should have a cloud and cloud disappearance point which is appreciably below +5° C. and even below 0° C. In general, anionic surface active agents containing less than approximately 0.5% by weight of sodium chloride and less than approximately 2% by weight of sodium sulfate are chosen.

Another characteristic of the invention is that the stable sulfonic acids, for example alkylbenzenesulfonic acid, are neutralized before any preparation of concentrated composition, and this enables them to be employed in compositions containing 20%, just as those containing 40% or 60% or 80% of active substances. The neutralization is preferably performed with monoethanolamine in the presence of ethanol and an ethoxylated alcohol containing an alkyl radical with 10 to 12 carbon atoms and preferably 5 EO. Neutralization with a chosen base produces compounds which are sufficiently soluble to avoid precipitation.

The nonaqueous solvent according to the invention is chosen from alcohols, glycols, glycol ethers, ketones and mixtures thereof and preferably, for example, isopropanol, ethanol and mixtures thereof. The quantities of nonaqueous solvents in the composition according to the invention are from approximately 0% to approximately 10% by weight. In the most highly concentrated compositions, the quantity of alcohol is less than approximately 10% by weight.

If desired, the composition according to the invention may include a nonionic surface active agent whose role is to make the concentrated composition more fluid. Ethoxylated fatty alcohols, ethoxylated alkylphenols, alkanolamides of fatty acids, ethoxylated if desired, and mixtures thereof are preferably chosen. An example of an ethoxylated fatty alcohol which may be mentioned is aliphatic $C_{10}$–$C_{18}$ alcohols containing from 1 to 100 EO. A $C_{10}$–$C_{12}$ aliphatic alcohol containing 5 EO is preferably chosen.

According to the invention, if desired, the composition may include a surface active agent which solubilizes the fragrances, for example a polyethoxylated sorbitan monooleate containing, on average, 20 EO in the molecule, a fragrance, a colorant, and a preservative. The total quantity of the nonionic surface active agent is preferably smaller than the total quantity of the anionic surface active agent, because the solutions according to the invention are detergent and detergency is conferred chiefly by the anionic surface active agents. The total quantity of nonionic surface active agent in the concentrated composition is from approximately 0% to approximately 45% by weight.

The hydrotropes which may be added, if desired, are, for example, sodium, potassium or ammonium salts of xylenesulfonate, toluenesulfonate, ethylbenzenesulfonate, isopropylbenzenesulfonate, n-amylsulfate and n-hexylsulfate, urea, and mixtures thereof. The quantity of hydrotrope in the composition is from approximately 0% to approximately 5% by weight.

According to the invention, when coregulator salts which are capable of decomposing in a basic medium, such as ammonium lactate, are employed, an acid which controls the pH of the concentrated solution is added, in order that the pH may be from approximately 5 to 7. For example, the compositions according to the invention contain sulfuric acid.

The invention relates, furthermore, to a process for controlling the viscosity $V_2$ of a diluted composition produced by diluting with water a concentrated composition of viscosity $V_1$. The concentrated compositions according to the invention are intended to be introduced into rigid or flexible packages and must therefore be capable of being poured into and out of these packages. The viscosity $V_1$ must therefore be controlled so that it is below approximately 800 mPa s (centipoises), preferably below approximately 500 mPa s, as measured in a Brookfield viscometer at 12 revolutions/minute with a No. 2 spindle. It is desirable, moreover, that the diluted composition should have a viscosity which is acceptable to the housewife, preferably that the viscosity $V_2$ should be greater than 50 mPa s, and more preferably greater than approximately 150 mPa s, or even of the order of approximately 300 mPa s.

To this end, the viscosity $V_1$ of the concentrated composition and the viscosity $V_2$ of the diluted composition are adjusted by adding at least one anionic surface active agent mixed, if desired, with at least one nonionic surface active agent, a viscosity regulator consisting of at least one nonionic, amphoteric or zwitterionic surface active agent and an acid or its salt so that the viscosity of the diluted composition decreases as a function of the proportion of the soluble coregulator salt, or that this viscosity increases and then decreases as a function of the proportion of coregulator salt.

BRIEF DESCRIPTION OF THE DRAWING

The present invention is illustrated in greater detail with reference to the single FIGURE in the appended drawings, which show that variation in viscosity of the diluted and concentrated compositions. The abscissa axis shows the percentage of soluble salt. The abscissa axis shows the percentages of salt in the concentrated composition and in the diluted composition respectively. The ordinate axis shows the viscosity of the composition. The curves shown as continuous lines show the variation of viscosity of concentrated compositions containing, as viscosity coregulator salts:

magnesium sulfate, denoted by ×
potassium phosphate, denoted by +
ammonium sulfate, denoted by Δ
ammonium propionate, denoted by ○
sodium lactate, denoted by ▭
ammonium lactate, denoted by ∇

The curves shown as broken lines shown the variation in the viscosity of the diluted composition. Depending on the weight percentage of salt, on the weight percentage of viscosity regulator and depending on the dilution (2 to 6-fold), a viscosity $V_1$ is obtained for the concentrated composition, and a viscosity $V_2$ for the diluted composition, which may be controlled.

The description which follows, with reference to the examples which do not imply any limitation, will make it possible to understand how the invention may be implemented in practice.

Unless indicated otherwise, the percentages are given by weight of the total composition and the concentrated compositions are diluted fourfold. The following abbreviations are used:

EO: ethylene oxide
PO: propylene oxide
ABS: alkylbenzenesulfonate
PS: paraffinsulfonate
AES: alkyl ether sulfate
NI: nonionic
DEA: diethanolamide
TEA: triethanolamine

COMPARATIVE EXAMPLE 1

The following mixture is prepared (Example 3C of EP Application No. 77,674):

15.0% of coconut amidobetaine
5.0% of sodium sulfate
2.4% of sodium alpha-olefinsulfonate
q.s. 100% of water.

The composition has a viscosity of 2600 mPa s. It is a composition of relatively low concentration, containing 17% of active substances.

When the proportion of active substances is increased, that is when the percentage of alpha-olefin-sulfonate is increased, the viscosity falls, and a diluted composition of satisfactory viscosity is not produced.

EXAMPLE 1

Preparation of Alkyl($C_{10}$–$C_{12}$)Benzenesulfonic Acid Neutralized With Triethanolamine Triethanolamine (approximately 528 g) is poured in small portions into 1000 g of alkylbenzenesulfonic acid, the mixture being cooled to approximately 50° C. A nonionic surface agent with is a $C_{10}$–$C_{12}$ alcohol ethoxylated with 5 EO, and ethanol, that is approximately 195 g of ethoxylated alcohol and approximately 220 g of ethanol, are poured in alternately at the same time. The reaction mixture changes from greenish brown to light yellow as the neutralization proceeds. The final pH is about 7.

A triethanolamine ABS composition at a concentration of 73–77% by weight is obtained.

COMPARATIVE EXAMPLE 2

A composition containing 40% of anionic active substances is prepared. The following mixture is prepared for this composition:

| | |
|---|---|
| ABS neutralized with triethanolamine | 30% |
| ethoxylated $C_{10}$–$C_{12}$ alcohol 5 EO | 4.5% |
| sodium PS (paraffinsulfonate at a concentration of 93%) | 2% |
| sodium LES (lauryl ether sulfate) | 8% |
| amidobetaine | 4% |
| ethoxylated copra diethanolamide (5 EO) | 3.4% |
| NaCl | 2.25% |
| EtOH | 1.75% |
| water | q.s. 100% |

The salt, sodium chloride, is not sufficiently soluble in water and alcohol and separates out after a few hours.

EXAMPLE 2

The following composition according to the invention is prepared:

| | |
|---|---|
| 32.3% | of ABS neutralized with triethanolamine |
| 5.2% | of ethoxylated $C_{10}$–$C_{12}$ alcohol 5 EO |
| 8.5% | sodium AES |
| 12.75% | of copra diethanolamide |
| 6% | of ammonium lactate |
| 5% | of 1 M $H_2SO_4$ solution |
| 3% | of EtOH |
| q.s. 100% | of water |

The sulfuric acid is poured into the neutralized ABS, with stirring, followed by ethanol and the copra amide and, lastly, ammonium lactate followed by the sodium AES.

The composition obtained is clear, light-colored, ochre-yellow. It contains 40% of anionic active substances and 18% of nonionic active substances. Its viscosity is 130 mPa s on the first day and 160 mPa s on the second day.

This composition is diluted fourfold with water. The viscosity of the diluted composition is 400 mPa s on the first day and 470 mPa s on the second day. Its color is light yellow.

The cloud point is 0° C. and the cloud disappearance point is +2° C.

This composition is noteworthy in that:

the ABS is neutralized before the formulation, which makes it possible to produce a neutralized ABS capable of being employed for any other formulation, since it is not neutralized in situ, the diluted composition has a viscosity higher than the viscosity of the concentrated composition, the concentrated composition contains 60% of active substances, the concentrated and diluted compositions are transparent, and the quantity of alcohol is low, which allows the concentrated composition to be introduced into polyvinyl chloride tetrapacks, without the latter being damaged by the alcohol.

EXAMPLE 3

The following composition is prepared (the percentages are given on a weight basis relative to the weight of the composition):

45.6% of alkylbenzenesulfonic acid whose alkyl chain contains from 10 to 12 carbon atoms, neutralized with monoethanolamine, in the presence of ethanol and of "Lauropal 02–05", which is a $C_{10}$–$C_{12}$ alcohol containing 5 EO manufactured by Witco, 27% of "Lauropal 02–05", including that introduced with the neutralized alkylbenzenesulfonic acid, 7% of sodium LES, which is a fatty alcohol ($C_{12}$–$C_{14}$) ethoxylated with, on average, 2.2 EO and sulfated, 8% of "Antil 141" liquid manufactured by Goldschmidt, which is a compound of 40% of polyethoxylated propylene glycol dioleate containing, on average, 55 EO, 20% of water, and 40% of propylene glycol, 3.8% of ammonium lactate, 5.7% of ethanol, including that introduced with the neutralized alkylbenzenesulfonic acid, and water q.s. 100%.

Ammonium lactate is produced by neutralizing lactic acid with ammonia gas or solution.

The concentrated composition produced in this manner according to the invention has a viscosity of 250 mPa s. When 250 ml of this composition are diluted with 750 ml of water, for example tap water, a diluted composition with a viscosity of 300 mPa s is obtained. These compositions are clear and free from deposit. Their cloud points lie below −5° C. and down to −9° C.

EXAMPLE 4

Composition containing 24% of active substances.

| | |
|---|---|
| triethanolamine ABS | 11.2% |
| sodium laurylsulfate (LS) | 2.8% |
| copra diethanolamide | 10% |
| 1 M $H_2SO_4$ | 4% |
| sodium cumenesulfonate | 0.5% |
| isopropanol | 1% |
| salt X | Y % |
| water | q.s. 100% |

The percentage of salt and the nature of the salt are varied.

| Salt X | Concentration Y % | Appearance of the concentrated composition at ambient temperature | |
|---|---|---|---|
| Ammonium acetate | 4% | turbid | salts out |
| | 3% | clear | |
| Sodium chloride | 4% | turbid | salts out |
| | 3% | clear | |
| Magnesium sulfate | 10% | turbid | salts out |
| | 9% | clear | |
| Ammonium lactate | 16% | turbid | salts out |
| | 15% | clear | |

This example shows the influence of the quantity of salt which is added on the cloud point of the concentrated composition, depending on the solubility.

EXAMPLE 5

The following compositions are prepared: see Table I.

This example shows the influence of polyethoxylated propylene glycol dioleate containing 55 EO which makes it possible to lower the cloud point of the concentrated compositions containing 40% and 60% of active substances in combination with copra diethanolamide. The surface agent which depresses the cloud point represents between 0 and 50% by weight of the surface agent which controls the viscosity.

TABLE I

INFLUENCE OF THE NONIONIC CLOUD-POINT DEPRESSANT

| Type of product | Composition | 1 | 2 | 3 | 4 |
|---|---|---|---|---|---|
| Anionic | TEA ABS W (TEA ABS from Wibarco) | 32.3 | 32.3 | 18 | 18 |
| Anionic | Na LES (Witco Neopon) | 8.5 | 8.5 | | |
| Anionic | Na LS (Henkel Sipon LCS98) | | | 5.9 | 5.9 |
| NI (contributed by ABS) | Lauropal 0205 (Witco) ($C_{10}$–$C_{12}$ alcohol with 5 EO) | 4.5 | 4.5 | 2.5 | 2.5 |
| NI thickener | Coconut diethanolamide | 11.9 | 11.9 | 12.7 | 12.7 |
| Salt | Ammonium lactate | 6 | 6 | 4.5 | 4.5 |

TABLE I-continued

| INFLUENCE OF THE NONIONIC CLOUD-POINT DEPRESSANT | | | | | |
|---|---|---|---|---|---|
| pH controller | 1 M solution of $H_2SO_4$ | 5 | 5 | 5 | 5 |
| Hydrotrope | Na cumenesulfonate | | | 2 | 2 |
| Nonaqueous solvent | Ethanol | 3 | 2 | | |
| NI cloud-point depressant | Antil 141 L (Goldschmidt) (propylene glycol dioleate with 55 EO) | | 3.2 | | 3 |
| Substrate | $H_2O$ | q.s. | q.s. | q.s. | q.s. |
| Content of active substances | | 60 | 60 | 40 | 40 |
| | PHYSICAL CHARACTERISTICS | 1 | 2 | 3 | 4 |
| at t = 1 day at 20° C. | Viscosity of the concentrate (mPa s) | 128 | 122 | 134 | 128 |
| $V_{12}$ Brookfield Sp. 2 | Diluted viscosity (mPa s) | 390 | 424 | 320 | 270 |
| | Cloud point (in °C.) of the concentrate | 0/+2 | <−8 | +8/+9 | <−8 |

NOTES: The quantities are expressed in % of the formulation of 100% materials, except in the case of $H_2SO_4$, which is expressed in % of the formulation of 1 M solution, and in the case of Antil 141 L, which is expressed in % of the formulation of product as used.

It can be seen that the addition of Antil 141 L depresses the cloud point.

EXAMPLE 6

A composition containing 60% of active substances (total surface active agents) including approximately 40% of anionic surface active agents is prepared.

| Material | Weight per 200 g | As percentage |
|---|---|---|
| 76% TEA ABS (Witbarco) | 88.6 | ABS 33.7% Lauropal 5.2% |
| 70% Na LES (Witco Neopon) | 24.3 | 8.5 |
| Copra DEA (Witco Witcamide LDT/S) | 28 | 11.9 |
| 1 M $H_2SO_4$ | 10 | 5 |
| Antil 141 L (40% of propylene glycol dioleate with 55 EO) | 6 | 1.2 |
| Ethanol | 4 | 2 |
| Salt | X | X/2 |
| $H_2O$ | q.s. for 200 | q.s. for 100% |

Percentage of anionics = 42.1
Percentage of nonionics = 18.3

The nature of the salt and its quantity in the compositions are varied.

The following results are obtained with the various salts:

Sodium lactate

| % of salt in the concentrate | Viscosity (mPa s) with sodium lactate Composition: concentrated | diluted |
|---|---|---|
| 2 | 185 | 312 |
| 5.5 | 166 | 607 |
| 6 | 170 | 639 |
| 7 | 177 | 558 |
| 10 | 457 | 380 |

Solubility: slight deposit from 5.5% onwards in the concentrated composition; turbid and opaque at 10%.

Ammonium lactate

| % of salt in the concentrate | Viscosity (mPa s) with ammonium lactate Composition: concentrated | diluted |
|---|---|---|
| 2 | 168 | 366 |
| 3.5 | 150 | 656 |
| 4.5 | 146 | 664 |
| 5 | 141 | 644 |
| 6 | 140 | 595 |
| 10 | 166 | 219 |

Solubility: greater than 12% in the concentrated composition.

Magnesium sulfate

| % of salt in the concentrate | Viscosity (mPa s) with $MgSO_4.7H_2O$ Composition: concentrated | diluted |
|---|---|---|
| 1 | 212 | 146 |
| 2 | 196 | 390 |
| 3 | 185 | 540 |
| 4 | 171 | 496 |
| 5 | 173 | 317 |

Solubility: turbidity from approximately 7% onwards in the concentrated composition.

Potassium phosphate

| % of salt in the concentrate | Viscosity (mPa s) with $K_2HPO_4$ Composition: concentrated | diluted |
|---|---|---|
| 2 | 158 | 296 |
| 4 | 139 | 585 |
| 5 | 130 | 645 |
| 6 | 139 | 512 |
| 8 | 159 | 453 |

Solubility: slight deposit from 4% onwards in the concentrated composition. Significant deposition only after 6%. Considerable deposit at 8%.

Ammonium sulfate

| % of salt in the concentrate | Viscosity (mPa s) with $(NH_4)_2SO_4$ Composition: concentrated | diluted |
|---|---|---|
| 1 | 161 | 266 |
| 2 | 139 | 537 |
| 3 | 122 | 700 |
| 4 | 120 | 606 |
| 5 | 124 | 550 |

Solubility: salting-out phenomenon from 5% onwards in the concentrate.

Ammonium propionate

| % of salt in the concentrate | Viscosity (mPa s) with ammonium propionate Composition: concentrated | diluted |
|---|---|---|
| 1 | 170 | 268 |
| 2 | 148 | 472 |
| 3.5 | 129 | 521 |
| 5 | 117 | 414 |
| 7 | 117 | 209 |

Solubility: solubility limit higher than 10% in the concentrate.

The viscosity curves are given in FIG. 1.

EXAMPLE 7

Concentrated compositions containing approximately 80% of active substances are prepared.

| Material | Weight per 200 g | As percentage |
|---|---|---|
| 76% monoethanolamine ABS (Shell 102) | 119 | 43.7% |
| 70% LES (Witco Neopon) | 20 | 6.8 |
| Lauropal 0205 (Witco) | 40 | 26 |
| Antil 141 L (20% $H_2O$, 40% dioleate, 40% propylene glycol) | 16 | 3.2% as dioleate 3.2% as propylene glycol. |
| Salt | X | |
| Ethanol | 11.2 | 5.6% |
| Water | | q.s. 100% |

Percentages of: Total active substances = 79.6% Anionics = 50.5% Nonionics = 29.1%

The viscosities of the concentrated and diluted compositions are investigated as a function of the content of various salts.

The results are given in the following tables.

VISCOSITIES OF THE CONCENTRATE AND OF THE DILUTED COMPOSITION AS A FUNCTION OF THE CONTENT OF VARIOUS SALTS
Viscosity of the concentrate without salt = 262 mPa s
Diluted viscosity without salt = 664 mPa s

| % of salt in the concentrate | Viscosity (mPa s) with ammonium citrate Composition concentrated | diluted |
|---|---|---|
| 0.5 | 259 | 558 |
| 1 | 254 | 520 |
| 2 | 238 | 471 |

Solubility: A turbidity appears at 2% of ammonium citrate in the concentrate.

| % of salt in the concentrate | Viscosity (mPa s) with $MgSO_4.7H_2O$ Composition concentrated | diluted |
|---|---|---|
| 0.5 | 258 | 587 |
| 0.75 | 258 | 587 |
| 1 | 259 | 439 |
| 2 | 261 | 324 |

Solubility: The concentrate is turbid at 2% of $MgSO_4$.

| % of salt in the concentrate | Viscosity (mPa s) with ammonium propionate Composition concentrated | diluted |
|---|---|---|
| 0.5 | 262 | 575 |
| 1 | 236 | 460 |
| 2 | 244 | 327 |
| 4 | 232 | 161 |
| 6 | 221 | 95 |

Solubility: with 6% of salt in the concentrate, turbidity appears in the diluted composition.

| % of salt in the concentrate | Viscosity (mPa s) with ammonium lactate Composition concentrated | diluted |
|---|---|---|
| 0.5 | 254 | 574 |
| 1 | 260 | 518 |
| 2 | 246 | 392 |
| 4 | 254 | 221 |
| 6 | 265 | 132 |

-continued

VISCOSITIES OF THE CONCENTRATE AND OF THE DILUTED COMPOSITION AS A FUNCTION OF THE CONTENT OF VARIOUS SALTS
Viscosity of the concentrate without salt = 262 mPa s
Diluted viscosity without salt = 664 mPa s

| | | |
|---|---|---|
| 8 | 265 | 98 |

Solubility: with 8% of salt in the concentrate: a turbidity appears in the diluted composition.

EXAMPLE 8

Dilutions of the Concentrated Compositions Containing 80% of Active Substances When dilutions are carried out by the housewife, mistakes can readily be made: quantity of concentrated product employed, capacity of the dilution flask, etc. It is therefore important to allow for a fairly wide margin error in the case of dilution without the physical characteristics of the diluted composition being markedly altered.

| Type of product | Composition of the formula | % |
|---|---|---|
| Anionic | MEA ABS W (Wibarco monoethanolamine ABS) | 44 |
| Anionic | Na LES (Witco Neopon) | 6.75 |
| Nonionic flow-aid in the concentrate | Lauropal 0205 (Witco) ($C_{10}$–$C_{12}$ alcohol, 5 EO) | 26 |
| Nonionic viscosity controller | Antil 141 L (Goldschmidt) (propylene glycol dioleate with 55 EO) | 7.7 |
| Viscosity regulator salt | Ammonium lactate | 3.7 |
| Nonaqueous solvent | Ethanol | 5.6 |
| | $H_2O$ | q.s. 100 |
| | Physical characteristics | |
| $V_{12}$ Brookfield, spindle 2 | Viscosity of the concentrate (mPa s) | 367 |
| | Cloud point of the concentrate (°C.) | < −8 |

Note: Antil 141 L is expressed as product as used.

DILUTION

| Dilution ratio | Appearance of the diluted composition | Viscosity (mPa s) ($V_{12}$ Brookfield, spindle 2 at 20° C.) |
|---|---|---|
| 1/2 | diluted turbid, dephasing quickly | Low |
| 1/3 | diluted clear | 149 |
| 1/4 | diluted clear | 268 |
| 1/5 | diluted clear | 470 |
| 1/6 | diluted clear | 385 |
| 1/8 | diluted clear | |

NOTE: The dilutions are carried out using cold tap water and shaking manually.

It can be seen that wide margins of dilution error can be tolerated with these compositions.

EXAMPLE 9

Compositions at a concentration of 24% of active substances, containing cumenesulfonate as hydrotrope, are prepared. The results are given in Table II, which follows.

EXAMPLE 10

Compositions at a concentration of 36% of active substances are prepared. The viscosities of the diluted composition are given in Table III, which follows.

TABLE II

| Nature of the salt | TEA ABS (Shell 102) | Sodium laurylsulfate | Copra DEA | Isopro-panol | Sodium cumen-sulfonate | Salt | Viscosity (mPa s) of the concentrate | Viscosity (mPa s) diluted |
|---|---|---|---|---|---|---|---|---|
| NaCl | 10.5% | 3.5% | 10% | 1% | 0.5% | 2% | 172 | 80 |
| | 10.5% | 3.5% | 10% | 1% | 0.5% | 2.6% | 127 | 284 |
| | 10.5% | 3.5% | 10% | 1% | 0.5% | 3.2% | 99 | 325 |
| $Na_2SO_4$ | 10.5% | 3.5% | 10% | 1% | 0.5% | 3.2% | 167 | 128 |
| | 10.5% | 3.5% | 10% | 1% | 0.5% | 4% | 139 | 290 |
| | 10.5% | 3.5% | 10% | 1% | 0.5% | 4.8% | 119 | 329 |
| Na citrate, | 10.5% | 3.5% | 10% | 1% | 0.5% | 5.6% | 147 | 78 |
| $5H_2O$ | 10.5% | 3.5% | 10% | 1% | 0.5% | 6.8% | 119 | 222 |
| | 10.5% | 3.5% | 10% | 1% | 0.5% | 8.0% | 105 | 317 |
| Ammonium | 10.5% | 3.5% | 10% | 1% | 0.5% | 3.9% | 133 | 287 |
| lactate | 10.5% | 3.5% | 10% | 1% | 0.5% | 4.6% | 113 | 398 |
| | 10.5% | 3.5% | 10% | 1% | 0.5% | 5.3% | 98 | 332 |
| Mg chloride, | 10.5% | 3.5% | 10% | 1% | 0.5% | 1.08% | 295 | 132 |
| $6H_2O$ | 10.5% | 3.5% | 10% | 1% | 0.5% | 1.16% | 269 | 247 |
| | 10.5% | 3.5% | 10% | 1% | 0.5% | 1.24% | 239 | 326 |

TABLE III

| | 1 | 2 | 3 | 4 | 5 | 6 | Percentage |
|---|---|---|---|---|---|---|---|
| 76.6% TEA ABS (Wibarco) | 49.6 | 49.6 | 49.6 | 49.6 | 49.6 | 49.6 | 19 |
| Sodium LS (Henkel Sipon LCS 98) | 12.3 | 12.3 | 12.3 | 12.3 | 12.3 | 12.3 | 6 |
| Copra DEA (Witco Witcamide LDT/S) | 25 | 25 | 25 | 25 | 25 | 25 | 10.6 |
| 1 M $H_2SO_4$ | 9 | 9 | 9 | 9 | 9 | 9 | 4.5 |
| Sodium cumensulfonate | 4 | 4 | 4 | 4 | 4 | 4 | 2 |
| Antil 141 liquid (Goldschmidt) | 6 | 6 | 6 | 6 | 6 | 6 | 1.2 of dioleate propylene glycol |
| Ammonium lactate (74%) | 18 | — | — | — | — | — | 6.6 |
| Ammonium citrate | — | 14.8 | — | — | — | — | 7.4 |
| NaCl | — | — | 9.2 | — | — | — | 4.6 |
| Magnesium acetate | — | — | — | 4.8 | — | — | 2.4 |
| $MgCl_2.6H_2O$ | — | — | — | — | 3.2 | — | 1.6 |
| Sodium thiosulfate | — | — | — | — | — | 22 | 11 |
| $H_2O$ | 76.1 | 79.3 | 84.9 | 89.3 | 90.9 | 72.1 | q.s. 100% |
| TOTAL | 200 g | 200 g | 200 g | 200 g | 200 g | 200 g | |
| RESULTS | 1 | 2 | 3 | 4 | 5 | 6 | |
| Appearance | GOOD | GOOD | GOOD | GOOD | GOOD | GOOD | Brookfield |
| Viscosity of the concentrate | 149 | 141 | 135 | 301 | 351 | 144 | viscosity |
| Diluted viscosity | 357 | 350 | 345 | 321 | 242 | 326 | 12 rev/min |
| Cloud point | <−5° C. | <−5° C. | +13° C./ +17° C. | <−5° C. | <−5° C. | <−5° C. | in mPa s |
| | 38% AS | | | | | | |

What is claimed is:

1. A process for controlling the viscosity $V_1$ of a concentrated liquid composition comprising at least one anionic surface active agent and the viscosity $V_2$ of a diluted composition produced by adding water to the concentrated liquid composition comprising adding to the concentrated composition a viscosity regulator consisting of a) a viscosity regulating surface active agent selected from among nonionic, amphoteric and zwitterionic surface active agent, and b) a viscosity coregulator selected from among acids and their salts, the viscosity regulating surface active agent and the viscosity coregulator being selected such that increasing the concentration of the viscosity coregulator causes a decrease in viscosity, and viscosity regulator being added in an amount effective to control viscosity.

2. A process for controlling the viscosity $V_1$ of a concentrated liquid composition comprising at least one anionic surface active agent and the viscosity $V_2$ of a diluted composition produced by adding water to the concentrated liquid composition comprising adding to the concentrated composition a viscosity regulator consisting of a) a viscosity regulating surface active agent selected from among nonionic, amphoteric and zwitterionic surface active agent, and b) a viscosity coregulator selected from among acids and their salts, the viscosity regulating surface active agent and the viscosity coregulator being selected such that increasing the concentration of the viscosity coregulator causes an increase followed by a decrease in viscosity, said viscosity regulator being added in an amount effective to control viscosity.

3. A clear, concentrated liquid detergent composition comprising a) at least one anionic surface active agent; and b) a viscosity regulating component consisting of at least one viscosity regulating surface active agent selected from the group consisting of nonionic, amphoteric and zwitterionic surface active agents; and a viscosity coregulator selected from among acids and their salts, wherein the viscosity regulating surface active agent and the viscosity coregulator are selected such that increasing the amount of the viscosity coregulator leads to a decrease in the viscosity of the composition or to an increase followed by a decrease in the viscosity of the composition; and c) water.

4. The composition as claimed in claim 3, wherein that the total quantity of surface active agents does not exceed 90% by weight and the ratio of the total quantity of anionic surface active agents to the total quantity of nonionic surface active agents is greater than 1.

5. The composition as claimed in claims 3 or 4, wherein the viscosity surface regulating agent of the viscosity includes a surface active agent chosen from the group consisting of the amides of $C_8$–$C_{20}$ fatty acids and of amine of formula

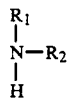

in which $R_1$ and $R_2$ are similar or different and are H, or a $C_1$–$C_4$ alkyl group substituted by one or more OH groups; mono- or polyfunctional, optionally oxyethylenated or oxypropylenated, amides of an acid containing a saturated alkyl or alkenyl chain;

alkylbetaines of formula

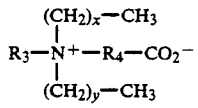

in which $R_3$ is an alkyl or alkenyl radical containing 8 to 20 carbon atoms, $R_4$ is $(—CH_2)_z—$ or $—CH_2—CH(OH)—(CH_2)_z$ x, and y are similar or different integers from 0 to 5;

z is an integer from 1 to 5;

alkylsulfobetaines of formula

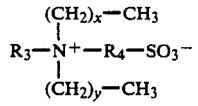

in which $R_3$, $R_4$, x, y and z have the same meanings as above;

alkylaminobetaines of formula

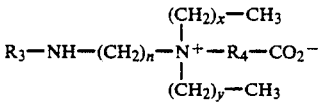

in which $R_3$, $R_4$, x, y and z have the same meanings as above and n is an integer from 1 to 6;

alkylaminosulfobetaines of formula

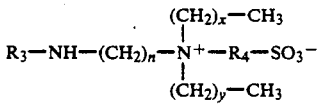

in which $R_3$, $R_4$, x, y, z and n have the same meanings as above;

alkylamidosulfobetaines of formula

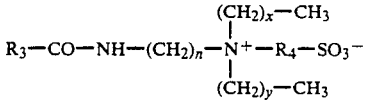

in which $R_3$, $R_4$, x, y, z and n have the same meanings as above;

esters of a fatty acid and of a polyethoxylated and/or polypropoxylated alkylene polyol containing from 1 to 100 ethylene oxide and/or propylene oxide groups, and in which the fatty acids contain from 8 to 20 carbon atoms and the polyols are chosen from 1,2- ethanediol, 1,2-propanediol, 1,2-butanediol, glycerol, sorbitan and glucose.

6. A composition as claimed in claim 5, further comprising at least one surface active agent which is effective to depress the cloud point of the concentrated composition.

7. The composition as claimed in claim 6, wherein the surface active agent which depresses the cloud point is present in an amount up to 50% be weight of the viscosity regulating surface active agent.

8. The composition as claimed in claim 7, which contains a mixture of nonionic viscosity regulating surface active agents consisting of polyethoxylated propylene glycol dioleate containing 55 EO and copra diethanolamide.

9. The composition as claimed in claim 8, wherein the anionic surface active agent is an alkylarylsulfonic acid in which the alkyl chain contains from 8 to 18 carbon atoms, and which is neutralized with an amine containing from 1 to 3 hydroxyalkyl groups.

10. The composition as claimed in claim 9, wherein the anionic surface active agent is an alkyl($C_8$–$C_{14}$)benzenesulfonic acid neutralized with monoethanolamine in the presence of ethanol and an ethoxylated alcohol containing a $C_{10}$–$C_{12}$ alkyl radical and 5 EO.

11. The composition as claimed in claim 10, which contains at least 40% by weight of surface active agents and wherein the anionic surface active agent contains practically no ions capable of forming salts which can precipitate out.

12. The composition as claimed in claims 3 or 4, wherein the viscosity coregulator is a salt of general formula

A—C (I)

in which A is an anion chosen from the group consisting of saturated or unsaturated aliphatic groups containing one to eight carbon atoms and, if desired, containing hydroxyl groups, such as lactate, propionate, succinate, malate, or and C is a cation chosen from the group consisting of sodium, potassium, calcium, ammonium, alkanolammonium, magnesium, iron and copper ions.

13. The composition as claimed in claim 12, wherein the anion A is selected from the group consisting of lactate, propionate, succinate, malate, glycolate; and salts of glyceric, tartaric, citric, gluconic, saccharic, formic, acetic, butyric, oxalic, maleic, and itaconic acid.

14. The composition as claimed in claim 3, which contains from 15 to 90% by weight of a mixture of at least one anionic surface active agent and at least one viscosity regulating surface active agent, from 0.5 to 20% of a dissolved salt as the viscosity coregulator, and further comprising up to 10% of an alcoholic solvent.

15. The composition as claimed in claim 14, which contains:

from 10 to 70% by weight of at least one anionic surface active agent, from 2 to 20% by weight of at least one viscosity regulating surface active agent, from 0.5 to 20% of the dissolved salt, and further comprising up to 45% by weight of a nonionic surface active agent which improves flow.

16. The composition as claimed in claims 14 or 15, which contains:

| | |
|---|---|
| 45% | of monoethanolamine alkyl($C_{10}$–$C_{12}$)benzenesulfonate, |
| 7% | of sodium laurylether sulfate, |
| 3% | of propylene glycol dioleate containing 55 EO, |
| 3% | of propylene glycol, |
| 27% | of ethoxylated alcohol ($C_{10}$–$C_{12}$) containing 5 EO, |
| 4% | of ammonium lactate, |
| 6% | of ethanol, |

17. The composition as claimed in claims 14 or 15, which contains:

| | |
|---|---|
| 34% | of triethanolamine alkyl ($C_{10}$–$C_{12}$) benzenesulfonate, |

-continued

| | |
|---|---|
| 5% | of an ethoxylated alcohol ($C_{10}$–$C_{12}$) containing 5 EO, |
| 8.5% | of a sodium alkyl ($C_{12}$–$C_{14}$) ether sulfate containing 2.2 EO, |
| 11.9% | of copra diethanolamide, |
| 1.2% | of an ethoxylated propylene glycol dioleate containing 55 EO, |
| 1.2% | of propylene glycol, |
| 3.5% | of ammonium lactate, |
| 5% | of sulfuric acid as 1M solution, |
| 2% | of ethanol, |

18. The composition as claimed in claim 3, further comprising at least one nonaqueous solvent.

19. The composition as claimed in claim 18, wherein the solvent is an alcohol chosen from ethanol, isopropanol and mixtures thereof.

20. The composition as claimed in claim 3, wherein the anionic surface active agent contains less than approximately 0.5% by weight of sodium chloride.

21. The composition as claimed in claim 20, wherein the anionic surface active agent (a) contains less than approximately 2% by weight of sodium sulfate.

22. The composition as claimed in claim 3, further comprising at least one hydrotrope.

23. The composition as claimed in claim 5, wherein the viscosity regulating surface active agent is chosen from copra diethanolamide, an amidosulfobetaine in which the radical $R_3$ is a saturated alkyl radical containing from 10 to 16 carbon atoms and $R_4$ is —$CH_2$—CHOH—$CH_2$, and ethoxylated propylene glycol dioleate containing, on average, 55EO in the molecule.

24. The composition as claimed in claim 23, wherein the anionic surface active agent (a) is neutralized beforehand.

* * * * *

UNITED STATES PATENT AND TRADEMARK OFFICE

CERTIFICATE OF CORRECTION

PATENT NO. : 5,057,246

DATED : October 15, 1991

INVENTOR(S) : Bertho et al.

It is certified that error appears in the above-identified patent and that said Letters Patent is hereby corrected as shown below:

Col. 3, line 42, "leas" should read --least--;
Col. 7, line 43, "that" should read --the--;
Col. 8, line 37, "with" should read --which--;
Col. 9, line 55, "8% of ..." should start a new line;
Col. 15, line 62, "and viscosity" should read --said viscosity--;
Col. 17, line 8, "that the" should read --the--;
Col. 17, lines 13-14, "surface regulating agent of the viscosity" should read --regulating surface active agent--;
Col. 18, lines 58-59, delete "groups, such as lactate, propionate, succinate, malate, or";
Col. 19, following line 29, insert --the remainder being water.--;
Col. 20, following line 11, insert --the remainder being water.--.

Signed and Sealed this

Sixth Day of July, 1993

Attest:

Michael K. Kirk

MICHAEL K. KIRK

Attesting Officer

Acting Commissioner of Patents and Trademarks